United States Patent [19]

Adamek

[11] Patent Number: 4,530,461

[45] Date of Patent: Jul. 23, 1985

[54] SIFT RESISTANT ECONOMY SEAL CARTON

[75] Inventor: David J. Adamek, Minneapolis, Minn.

[73] Assignee: Champion International Corporation, Stamford, Conn.

[21] Appl. No.: 547,868

[22] Filed: Nov. 2, 1983

[51] Int. Cl.[3] ..... B65D 5/02

[52] U.S. Cl. ..... 229/37 R; 229/43

[58] Field of Search ..... 229/37 R, 37 E, 44 R, 229/43, 38

[56] References Cited

U.S. PATENT DOCUMENTS

| | | | |
|---|---|---|---|
| 2,563,619 | 8/1951 | Ringler | 229/37 R |
| 3,003,677 | 10/1961 | Hennessey | 229/37 R |
| 3,144,978 | 8/1964 | Asman | 229/37 R |
| 3,197,109 | 7/1965 | Nelson | 229/37 R |
| 3,934,791 | 1/1976 | Dick et al. | 229/37 R |
| 4,072,263 | 2/1978 | Focke | 229/37 R |
| 4,083,486 | 4/1978 | Bergstein | 229/37 R |

FOREIGN PATENT DOCUMENTS

| | | | |
|---|---|---|---|
| 700533 | 12/1964 | Canada | 229/37 R |
| 2260766 | 6/1973 | Fed. Rep. of Germany | 229/38 |
| 1107880 | 1/1956 | France | 229/37 R |
| 1012074 | 12/1965 | United Kingdom | 229/37 R |

*Primary Examiner*—Allan N. Shoap
*Assistant Examiner*—Bryon Gehman
*Attorney, Agent, or Firm*—Evelyn M. Sommer; William W. Jones

[57] ABSTRACT

A paperboard carton, of improved end sealability, has two end flaps with debossed portions, a third end flap with an embossed portion, and a fourth, planar, end flap captured between the debossed and embossed flaps. The debossed end flaps comprise an opposed pair connected to the narrower side panels of the carton, while the embossed and planar flaps are connected to the relatively wider front and back panels respectively. Due to the effectiveness of the end closure, substantial flap overlap is no longer required for adequate sealing and it is possible to substantially reduce the length of the end flaps connected to the side panels and the back panel, as compared to those of a conventional carton of the same overall size.

3 Claims, 6 Drawing Figures

SIFT RESISTANT ECONOMY SEAL CARTON

BACKGROUND AND SUMMARY OF THE INVENTION

This invention relates to an improvement in tightly sealed paperboard cartons and, more particularly, to a tubular carton having tightly sealed ends.

Paperboard cartons are an inexpensive and convenient method for storage, shipment and display of almost any type of product. However, where the carton contents include or comprise finely divided material, such as powders or granulated material, it is necessary that the end closures of the carton be tightly sealable. Such seal is necessary both to keep the contents from sifting out through the seams and, in the case of food products, to prevent insects from gaining entry into the carton.

Commonly, this problem is overcome by providing the carton with an internal bag closure, or by overwrapping the carton with a paper wrapper or a cellophane film. Such methods, however, add to the complexity of filling and sealing the cartons, to the cost of the packaging and to the shipping weight of the filled package.

Embossing of end flaps so that they lie in closer relationship is also common, as described in U.S. Pat. Nos. 3,003,677 and 3,934,791. This solution, however, requires a substantial overlapping of the carton end flaps and, therefore, the use of an excessive amount of paperboard material.

It is, therefore, a primary object of the present invention to provide a tubular carton having ends more effectively sealed than those of conventional cartons. This is accomplished, in general, by a carton having two end flaps with debossed portions, a third end flap with an embossed portion, and a fourth planar, end flap captured between the debossed and embossed flaps. More specifically, the debossed end flaps comprise an opposed pair connected to the narrower side panels of the carton, while the embossed and planar end flaps are connected to the relatively wider front and back panels respectively.

It is another object of the invention to provide a carton as above-described, which requires a minimum amount of paperboard. This is accomplished by reducing the length of three of the end flaps, as compared to those of a conventional carton of the same overall size. Such reduction is possible because the superior end closure of the present invention, wherein one end flap is captured between the others, eliminates the need for the substantial flap overlap heretofor required for effective sealing.

Sealing of the present end closure is effected by first folding the debossed end flaps to a position perpendicular to the carton side panels. The planar end flap is then folded so as to rest on the debossed end flap portions. Finally, the embossed flap is brought into juxtaposition with the other three flaps, whereupon the embossed portion thereof overlies the planar flap.

DESCRIPTION OF THE PREFERRED EMBODIMENT

Figure 1:
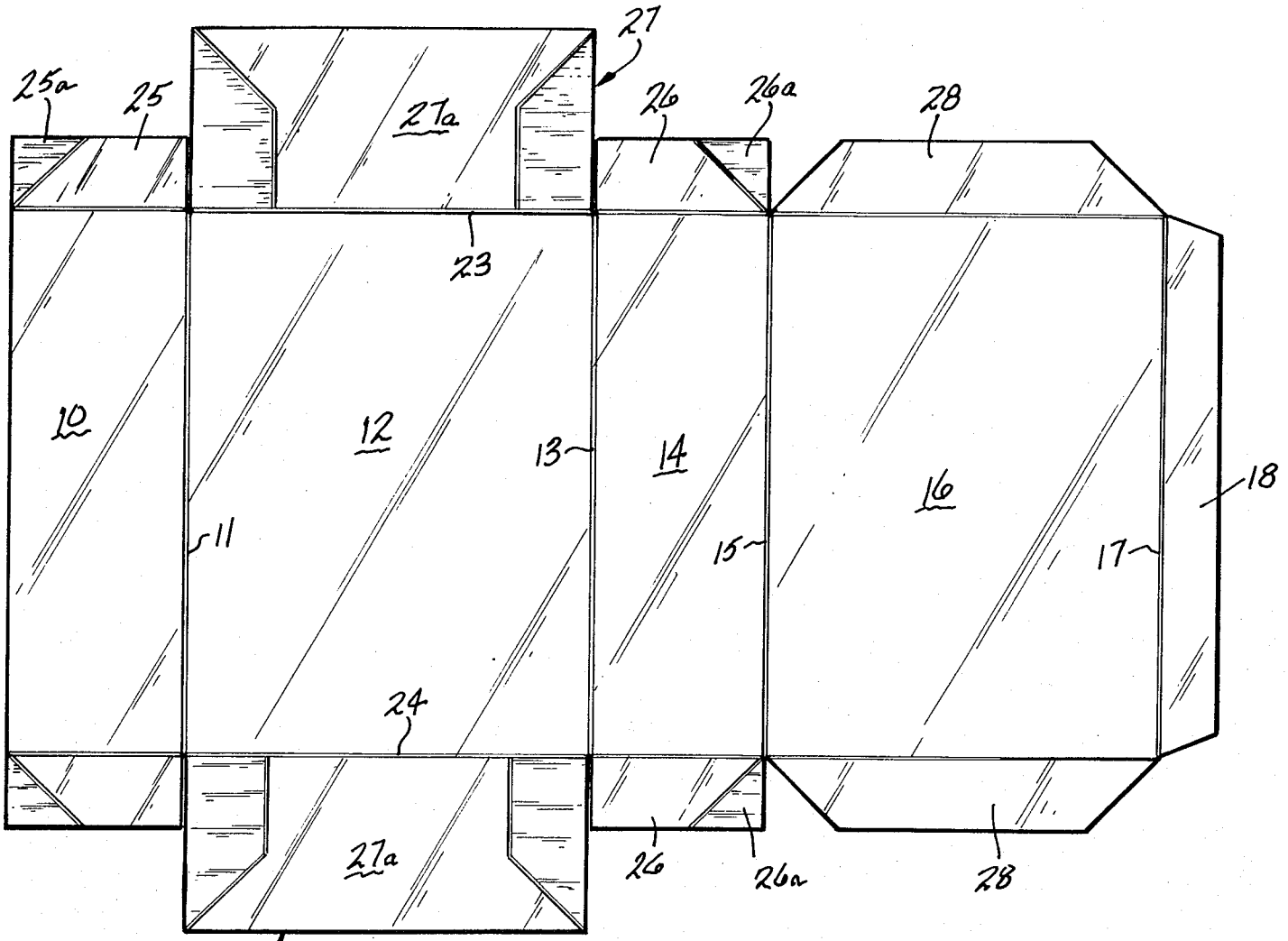
FIG. 1 is a blank, shown in plan view, which is adapted to be folded into a carton in keeping with the present invention.

As illustrated in FIG. 1, the carton of the present invention includes a first side panel 10 which is foldably connected, along a fold line 11, to a front panel 12. The front panel 12 is foldably connected, along a fold line 13, to a second side panel 14 which, in turn, is foldably connected, along a fold line 17, to a glue flap 18.

End closure flaps are connected to the various panels along parallel lines of fold 23 and 24. The first end flaps 25, which are connected to the first side panel 10, and the second end flaps 26, which are connected to the second side panel 14, each include a debossed portion 25*a* and 26*a* respectively. The debossed portions 25*a* and 26*a* are offset from the planes of their respective end flaps of a distance equal to one half the thickness of the paperboard material employed. The first and second end flaps 25 and 26 respectively are collectively termed "minor end flaps." The front end flaps 27, which are connected to the front panel 12, each include an embossed central portion 27*a* which is offset from the plane of the flaps by a distance equal to one half of the thickness of the paperboard material employed. The back end flaps 28, which are connected to the back panel 16, are planar. It is to be noted that the front end flaps 27 are each substantially equal in area to the end area of the carton, while the back end flaps 28 are of substantially lesser area, in this instance being each approximately one third of said area. Likewise, the minor end flaps 25 and 26 are each substantially less than one half of this area, in this instance being approximately one sixth.

Figure 3:
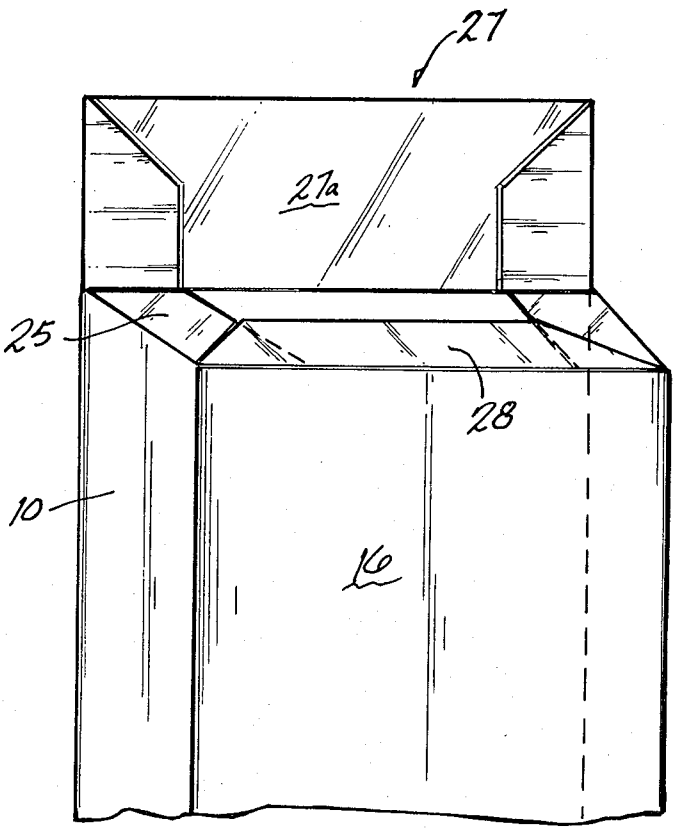
FIG. 3 is a perspective view of the end of the carton of FIG. 2, with the planar end flap folded into position resting on the debossed flaps.
Figure 2:
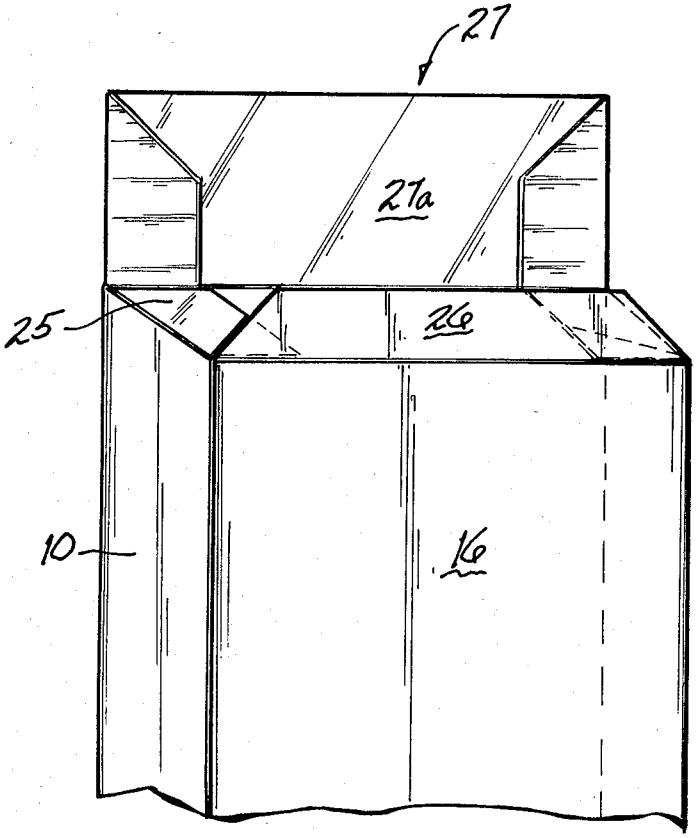
FIG. 2 is a perspective view of an end of a carton produced from the blank of FIG. 1, with the debossed end flaps folded into position and the other end flaps yet open.
Figure 5:
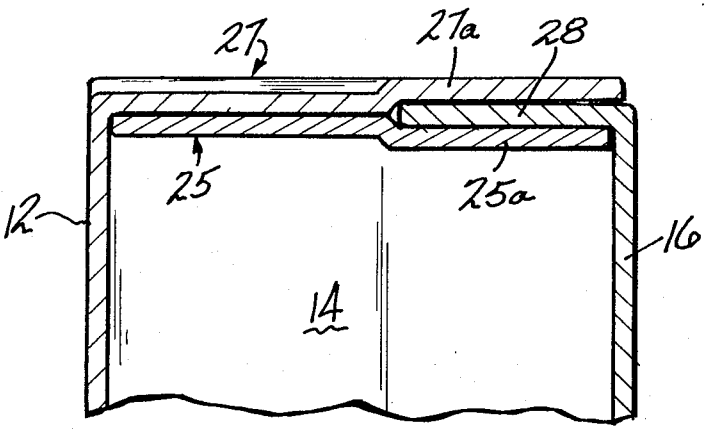
FIG. 5 is a cross-sectional view taken along line 5—5 of FIG. 4.
Figure 4:
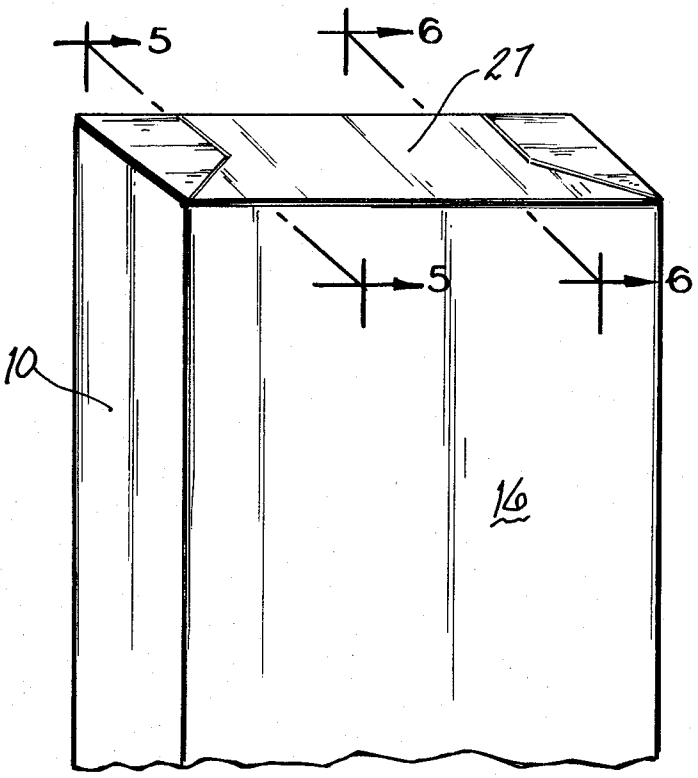
FIG. 4 is a perspective view of the end of the carton of FIG. 2 fully sealed.

The method of erection of the carton is illustrated in FIGS. 2–4, wherein only the upper portion of the carton is shown, it being understood that both ends are identical in structure and method of closure. In FIG. 2, the glue flap 18 has been adhesively bonded to the first side panel 10 and the minor end flaps 25 and 26 have been folded into position perpendicular to the carton side panels 10 and 14. As illustrated in FIG. 3, the planar rear end flap 28 is next folded so as to rest on the debossed portions 25*a* and 26*a* of the minor end flaps 25 and 26 and is adhesively bonded thereto by means known in the art. Finally, as illustrated in FIG. 4, the front end flap 27 is brought into juxtaposition with the other end flaps 25, 26 and 28, whereupon the embossed portion 27*a* overlies the planar back end flap 28 and is adhesively bonded thereto by means known in the art. As seen in FIG. 5, the back end flap 28 is now securely captured between the embossed portion 27*a* of the front end flap 27 and the debossed portions 25*a* and 26*a* of the minor end flaps 25 and 26. At the same time, the front end flap 27 is in facing relation to the minor end flaps 25 and 26, to which it is adhesively bonded by means known in the art.

Figure 6:
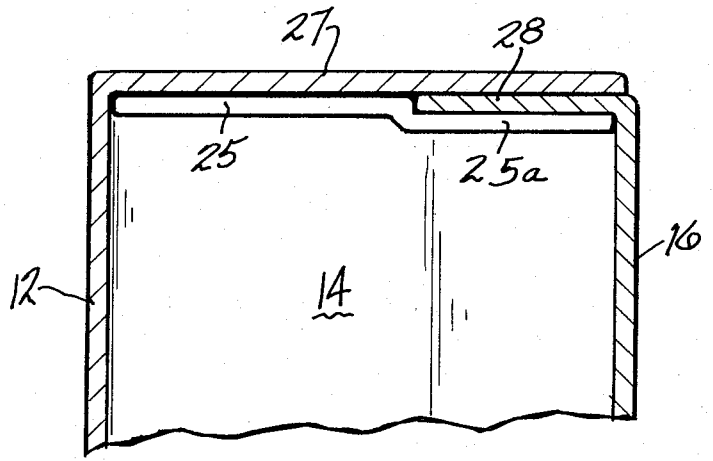
FIG. 6 is a cross-sectional view taken along line 6—6 of FIG. 4.

Due to the effectiveness of the end closure above described, wherein one end flap is captured between the others, substantial flap overlap is no longer required to insure adequate sealing. It is, therefore, possible to substantially reduce the length of the minor end flaps and back end flap, as compared to those of a conventional carton of the same overall size. This minimization of flap overlap, which is best seen in FIG. 6, results in a savings of material and a corresponding reduction in shipping weight.

While the invention has been described with reference to a preferred embodiment, it should be understood that various changes in the relative dimensions of the parts and in the arrangement thereof are contemplated and may be made without departing from the spirit of the invention, which is intended to be limited in scope only by the appended claims.

What is claimed is:

1. A paperboard carton comprising:

(a) front, back and side panels hingedly connected in series to form a tubular carbon body;

(b) first end closure flaps hingedly connected to at least one end of each of said side panels, said first end closure flaps being smaller in area than one-half of the cross-sectional area of said tubular carton body, and said first end closure flaps each having a debossed portion thereon;

(c) a back panel end closure flap hingedly connected to said back panel, said back panel end closure flap being trapezoidal in configuration and being smaller in area than one-half of the cross-sectional area of said tubular carton body, the non-parallel edges of said back panel end closure flap overlapping said debossed portions of said first end closure flaps; and (d) a front panel end closure flap hingedly connected to said front panel, said front panel end closure flap being substantially equal in area to the cross-sectional area of said tubular carton body, and said front panel end closure flap having an embossed central portion which overlies said back panel end closure flap and adjacent marginal debossed portions which overlie said first end closure flaps.

2. The carton of claim 1, wherein said debossed portions of said first end closure flaps have tapered edges which lie adjacent to said non-parallel edges of said back panel end closure flap.

3. The carton of claim 1, wherein said marginal debossed portions of said front panel end closure flap have tapered edge portions which lie adjacent to said non-parallel edges of said back panel end closure flap.

* * * * *